US008297491B2

(12) United States Patent
Kwok et al.

(10) Patent No.: US 8,297,491 B2
(45) Date of Patent: Oct. 30, 2012

(54) PACKAGING CONTAINER AND BLANK

(75) Inventors: John Kwok, East Hawthorn (AU); John Charles Punter, Frankston South (AU)

(73) Assignee: Cushionflute Pty. Ltd., Victoria (AU)

( * ) Notice: Subject to any disclaimer, the term of this patent is extended or adjusted under 35 U.S.C. 154(b) by 547 days.

(21) Appl. No.: 12/530,848

(22) PCT Filed: Mar. 13, 2008

(86) PCT No.: PCT/AU2008/000349

§ 371 (c)(1),
(2), (4) Date: Sep. 11, 2009

(87) PCT Pub. No.: WO2008/109952

PCT Pub. Date: Sep. 18, 2008

(65) Prior Publication Data

US 2010/0089989 A1 Apr. 15, 2010

(30) Foreign Application Priority Data

Mar. 13, 2007 (AU) ..... 2007901310

(51) Int. Cl.
*B65D 5/22* (2006.01)
*B65D 5/24* (2006.01)
*B65D 5/56* (2006.01)

(52) U.S. Cl. ..... 229/165; 229/5.84; 229/103.11; 229/186; 229/940; 229/941

(58) Field of Classification Search ..... 229/5.84, 229/117.07, 117.08, 164.1, 164.2, 170, 173, 229/186, 939, 940, 941, 103.11, 165; 220/592.2
See application file for complete search history.

(56) References Cited

U.S. PATENT DOCUMENTS

| | | | | |
|---|---|---|---|---|
| 674,220 | A * | 5/1901 | Scott | 229/173 |
| 2,177,856 | A * | 10/1939 | Bennett | 229/186 |
| 2,341,928 | A * | 2/1944 | Levkoff | 229/173 |
| 2,613,025 | A * | 10/1952 | Ringler | 229/164.1 |
| 3,074,798 | A * | 1/1963 | Palmer | 229/186 |
| 3,489,331 | A * | 1/1970 | Andersson | 229/5.84 |
| 3,885,730 | A | 5/1975 | Christensson | |
| 4,056,221 | A * | 11/1977 | Piltz et al. | 229/164.1 |
| 5,628,451 | A * | 5/1997 | Neary | 229/939 |
| 5,660,322 | A | 8/1997 | Jensen | |
| 7,879,436 | B2 * | 2/2011 | Kwok et al. | 229/103.2 |
| 2002/0011513 | A1 * | 1/2002 | Dowd | 229/117.16 |

FOREIGN PATENT DOCUMENTS

| | | | |
|---|---|---|---|
| CN | 1506281 | A * | 6/2004 |
| EP | 330138 | | 8/1989 |

* cited by examiner

*Primary Examiner* — Gary Elkins
(74) *Attorney, Agent, or Firm* — Chernoff Vilhauer McClung & Stenzel LLP

(57) ABSTRACT

A packaging carton for wet food such as meat and fish is made of a triple ply lamination, the top and bottom plies being plastic sheet, the intermediate ply being of carton material such as paperboard but in variants the ply is made of fluted board, honeycomb matrix or side by side thin walled tubes. The intermediate ply is cruciform allowing the corners to be rectangular areas of plastic plies joined together. These form, diagonal fold flaps which are adhered to the cruciform blank to form a fold flat carton precursor. A lid is constructed in the same manner and overlies the carton to form a container which withstands tape wrapping.

20 Claims, 7 Drawing Sheets

PACKAGING CONTAINER AND BLANK

This is a national stage application filed under 35 USC 371 based on International Application No. PCT/AU2008/000349 filed Mar. 13, 2008, and claims priority under 35 USC 119 of Australian Patent Application No. 2007901310 filed Mar. 13, 2007.

FIELD OF THE INVENTION

This invention concerns packaging and especially wet use cartons of the type and size used to hold wet food such as meat, vegetables or fish.

BACKGROUND OF THE INVENTION

Abattoirs butcher carcasses into cuts of meat for retailing such as chicken thighs, lambs fry, sheep kidneys and the like. These are placed in cardboard cartons which take about 25 kg. The cartons are about 500×500×200 mm. These are covered with lids of larger size and closed by three loops of polyester tape. The cartons are stacked on pallets in the coolroom before being freighted in refrigerated trucks to customers. Ocean fish and shellfish are similarly packed. Sometimes crushed ice is added.

Delays and accidents inevitably result in leakage and consequent deterioration of the cardboard. This may lead to wasteage of the food and loss to the shippers. The cartons may be recycled but they constitute a cost to the packing industry and the consumer.

PCT/US01/49291 describes a stackable carton with liquid tight corners created by diagonal fold flaps. The general cruciform shape of the blank in plan is evident. Such cartons are for light use only.

EP19840302640 shows a paperboard carton made waterproof by coating. The carton is for a small quantity of milk and has diagonal fold flaps.

U.S. Pat. No. 2,495,807 presents a double walled meat carton which is built up from a flat blank with corners reinforced by diagonal folding flaps. These pass through a glue applicator and the flaps are folded by hand. These rely on paraffin wax coating to render them suitable for containing meat but the cartons need only be strong enough to resist distortion when picked up by one hand.

SUMMARY OF THE INVENTION

A first product aspect of the invention provides a carton precursor for a liquid tight carton comprising a ply of carton substrate having an obverse face and a reverse face, the obverse face being laminated to a top ply of liquid impervious film, the reverse face being laminated to a bottom ply of liquid impervious film, the carton substrate ply defining corner areas where the top and bottom plies are laminated together to form diagonal fold flaps.

The carton substrate layer may be generally cruciform. The film may be cut from ribbon so that the cruciform blanks are sandwiched between two rectangles of film.

The carton substrate ply may be paperboard including corrugated paperboard, fluted board or honeycomb matrix selected for its rigidity.

The carton substrate may instead be made from multiple, side by side thin walled plastic tubes, such a substrate is described in Australian Patent Application No. 2006901079 which concerns packaging materials. In that application, we describe synthetic board made from arrays of thin walled plastic tubes fixed to one or more flexible face plies of plastic film.

The obverse and reverse faces of the carton substrate may both be laminated with a liquid impervious film and the film areas unoccupied by the carton substrate may be laminated to each other. The film may be a continuous ribbon. The carton substrate may be a generally cruciform in plan and also supplied as a ribbon when the blanks are joined end to end in a continuous run.

The carton substrate may be a layer of multiple, side by side, thin-walled tubes giving strength across the axes of the tubes but flexibility about the axes of the tubes. The carton substrate may instead be a cellulose base, that is paperboard and industry equivalents. The carton substrate may alternatively be a honeycomb ply selected for its rigidity.

A second product aspect of the invention provides a fold flat carton precursor for a liquid tight carton comprising a floor, a pair of side walls and a pair of end walls with diagonal fold flaps at the corners, each further comprising a bottom ply, a top ply and an intermediate ply, each side wall being joined to an end wall of an inwardly folding diagonal ply of double thickness, wherein the intermediate ply is made of multiple, side by side thin-walled plastic tubes.

The ends may be double the depth of the sides, whereby each end folds over itself to form an end of at least double thickness.

In the method of making the wet use carton from a blank with two plies the sides are raised upright, the portions lying between one side and an adjacent end are diagonally folded and the folding is repeated for the remaining portions, raising the ends and sides so that the portions each form an inwardly directed flap of double thickness.

A triangular portion of the flap of which the diagonal is the hypotenuse may be coated with adhesive prior to being folded so that the flap flattens when the ends of the carton become upstanding.

Alternatively, the portions forming the flaps may be heated to fuse the surfaces to a temperature where they self adhere.

When the ends are double the depth of the sides, the ends themselves may be folded transversely and tucked into the interior of the carton.

The method of making a flat precursor for a wet use carton from a flat carton blank comprises inserting a fold line in each portion thereby creating both a triangle lying adjacent the carton side and a triangle lying adjacent the carton end, applying adhesive to the triangle adjacent the carton end, folding the sides over the floor, folding the portions over the ends, adhering the triangle adjacent the end to the carton end or side.

The method produces a fold flat carton precursor ready for erection into a carton with upstanding sides and ends and the flaps at all four corners. The height of the sides are preferably half the width of the floor. This allows the precursor to be of double thickness, that is floor thickness and one wall thickness.

BRIEF DESCRIPTION OF THE DRAWINGS

Certain embodiments of the invention are now described with reference to the accompanying drawings, in which.

DETAILED DESCRIPTION WITH RESPECT TO THE DRAWINGS

Australian Patent Application No. 2006901079 describes three ply packaging materials comprising a transparent top ply and bottom ply made of polyethylene and an intermediate ply made of polypropylene tubes.

FIGS. 1-6 of this specification pertain to cartons made from blanks using an intermediate ply made from corrugated paperboard which is a carton precursor. Cartons are delivered to the end user as a stack fold flat precursors. Precursors from the stack are erected by hand because only simple hand movements are needed to form the carton and its lid.

Figure 1:
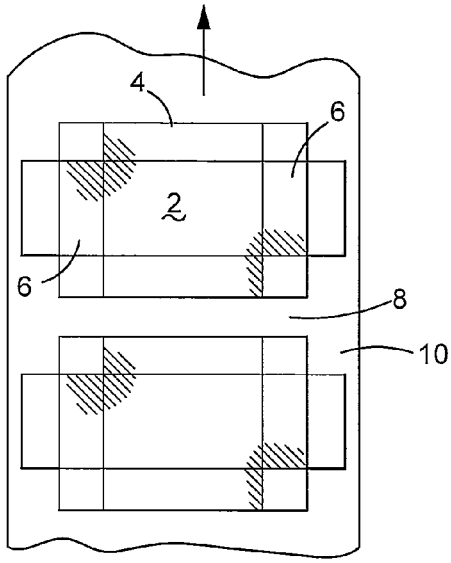
FIG. 1 is a plan of a ribbon of carton feedstock produced by a continuous laminator.

Referring now to the drawings, FIG. 1 is a plan of a ribbon of carton stock produced continuously by a laminator. The present corrugated paperboard ply has a floor 2, a pair of sides 4 and a pair of ends 6. The ratios of the dimensions of the parts of the carton are shown as x and 2x in FIG. 2.

Each intermediate ply blank is divided from the next by a break 8. The areas 10 between successive blanks are areas of film joined together by an adhesive coating applied during the lamination step plus the application of heat, 180-250° depending on the type of film.

Figure 2:
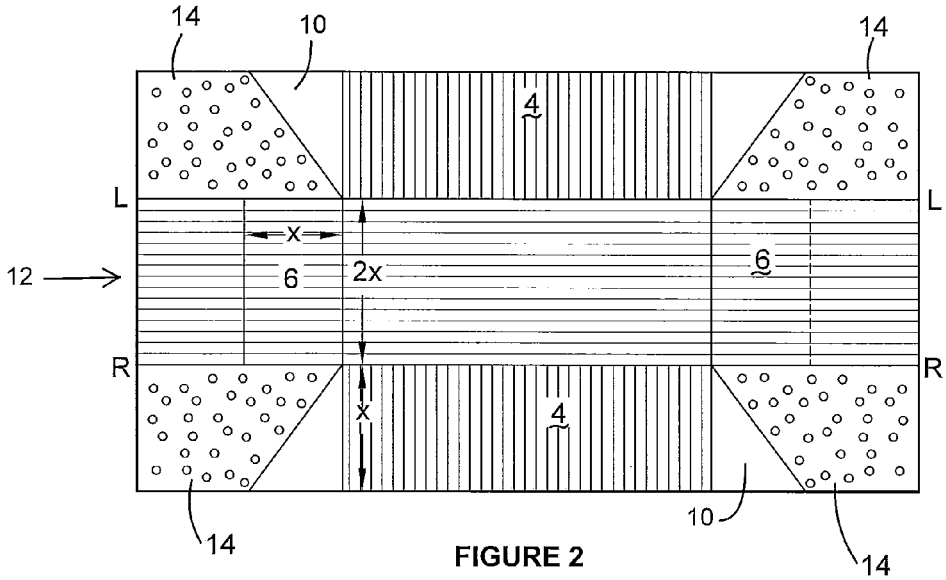
FIG. 2 is a plan of a single blank docked from the ribbon showing diagonal fold lines.
Figure 3:
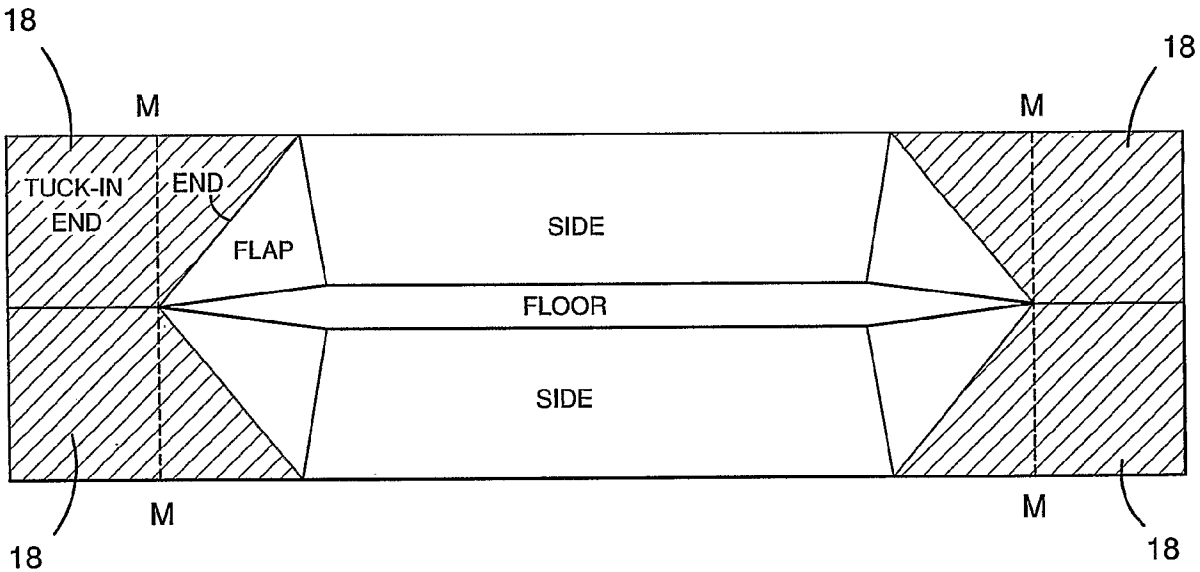
FIG. 3 is the blank of FIG. 2 and is the process of erection into a carton.
Figure 4:
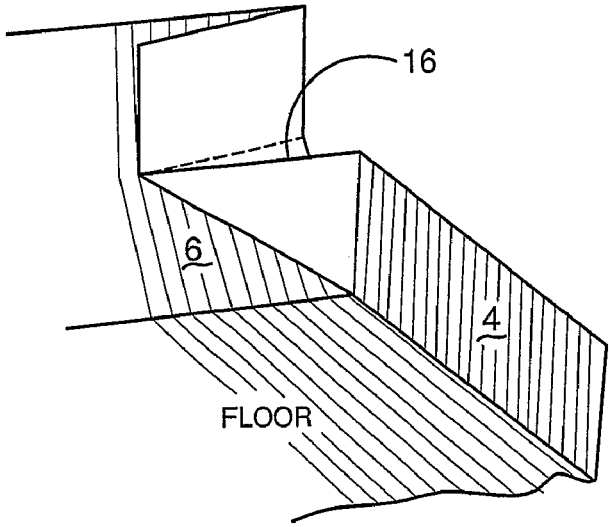
FIG. 4 shows the initial fold on the diagonal which forms the flap.

When the ribbon is docked at the break 8, a lid blank 12 is produced which is shown in FIG. 2. The blank is fed through an adhesive applicator which applies adhesive to the trapezoidal areas 14. The blank is then fed through a folder which folds areas 10 and 4 about fold line R-R and L-L to form the flat folded lid precursor shown in FIG. 3. FIG. 4 shows how the flap 16 is formed. These remain folded flat because the hatched areas 18 indicate, where film/film connection persists. The precursors are stacked and freighted to the user.

Figure 5:
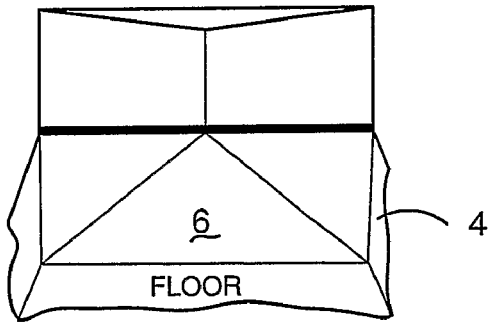
FIG. 5 shows both flaps at one end of the carton with the excess at the end ready to fold over.
Figure 6:
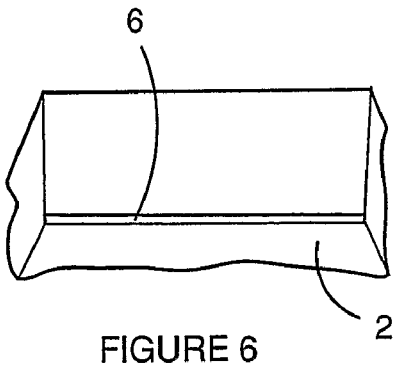
FIG. 6 shows the excess end folded over.

The user raises the sides 4 and folds in the "tuck-in" end around fold line M-M. The flaps have already folded to form a leak proof joint between the plies. The sequence of tucking in the end is shown in FIGS. 5 and 6. Cartons can be made in the same way but somewhat smaller than the lid so that the lid completely overlies the carton.

Figure 7:
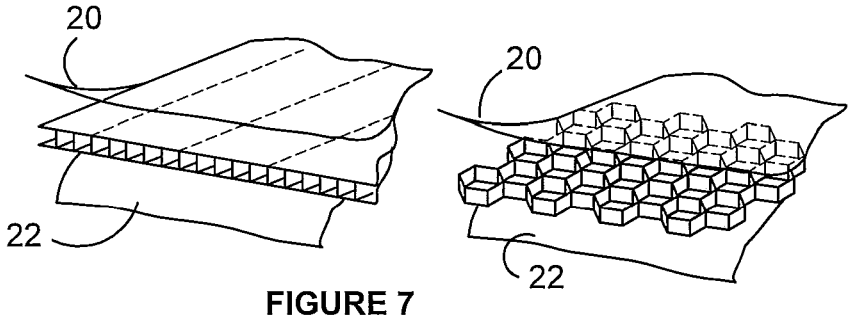
FIG. 7 shows fragments of variants using fluted board and hexagon matrix.

In a variant, the ends are shortened to be the same height as the sides 4. The adhered areas 18 are triangular and not trapezoidal. In a further variant the carton and lid are made from fluted board panels laminated to twin plies made of polythene sheet. Honeycomb matrix made in a hexagonal pattern made of polyethylene 3 mm thick is a still further variant. These are shown in FIG. 7.

Figure 8:
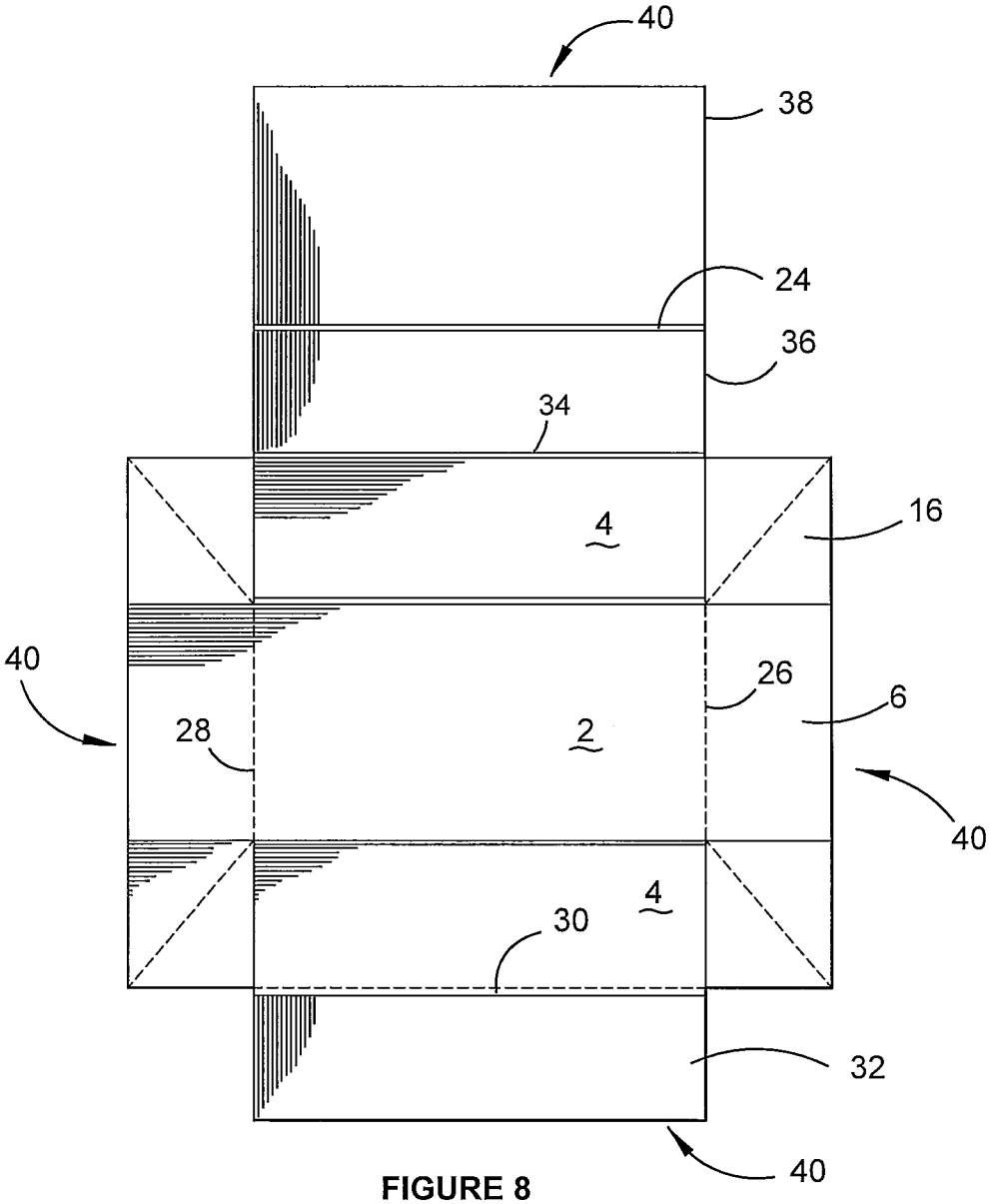
FIG. 8 is a plan of a meat carton blank.
Figure 9:
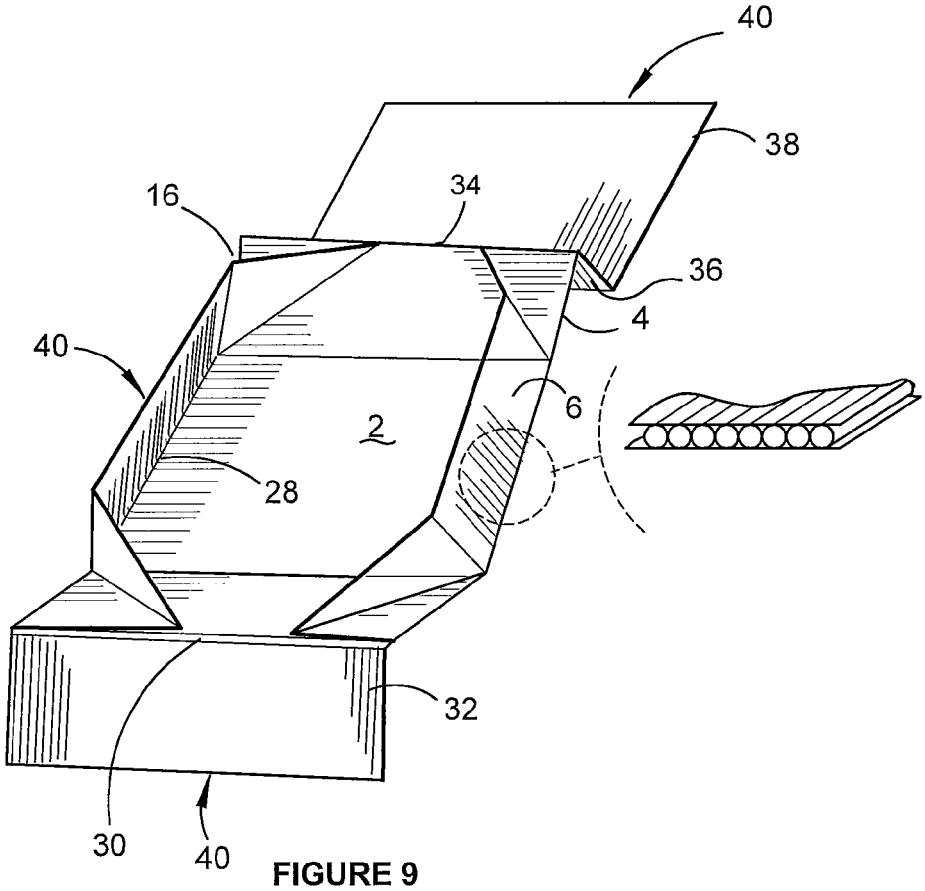
FIG. 9 is a perspective of the precursor in the course of assembly into a carton.
Figure 10:
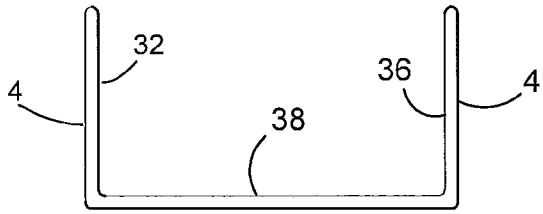
FIG. 10 is a section through the erected carton showing the double wall construction.

A fold flat carton precursor for erection into a meat tray made from synthetic board described in Australian Patent Application No. 2006901079 is shown in FIGS. 8-10.

Floor 2, side walls 4 and end walls 6 compose a cruciform part of the precursor in which all the tubes have a common direction. When the tubes are fed between the top ply 20 and bottom ply 22, a tube is omitted to create a gap 24 which functions as a hinge. Even though the gap is only the width of a single tube the absence of the tube allows ready articulation between the side walls 4 and the floor. Although the ends are extensions of the floor without any hinge, the tubes are bent at ambient temperature along two parallel axes 26, 28 lying at 90° to the axes of the floor tubes. Rectangular flaps 16 formed by adhering the top and bottom plies as in the previous embodiment lie at all four corners of the cruciform part. These fold diagonally to create the liquid light corners already described. The inherent spring in the tubes tends to unbend the ends 6 tending to raise them.

This carton is reinforced specially to reliably contain about 22 kg of meat or other wet product. A hinge 30 joins side wall 4 to extra wall 32, the tubes of which lie at 90° to the side wall.

Likewise hinge 34 joins opposite side wall 4 to extra wall 36 of equal depth. Again the tubes in extra wall 36 are 90° to the side wall tubes. Reinforcement of the floor is achieved by connecting floor overlay 38 to extra wall 36. The overlay is equal in shape to floor 2. The plies are sealed together around the perimeter 40 to seal the ends of the tubes.

The precursors are piled in a stack next to the meat processing line and when required the operator causes the precursor to assume the shape shown in FIG. 9. The bends 26, 28 predispose the blank to assume the shape shown leaving it to the operator to fold the extra wall 32 over side wall 4 and extra wall 36 over opposite side wall 4 and press overlay 38 on top of floor 2. The carton configuration is shown in section in FIG. 10. The double thickness structure is evident. A lid of somewhat larger construction is a slide fit on the carton. The filled carton is secured by three tape bands in a strapping machine.

Figure 11:
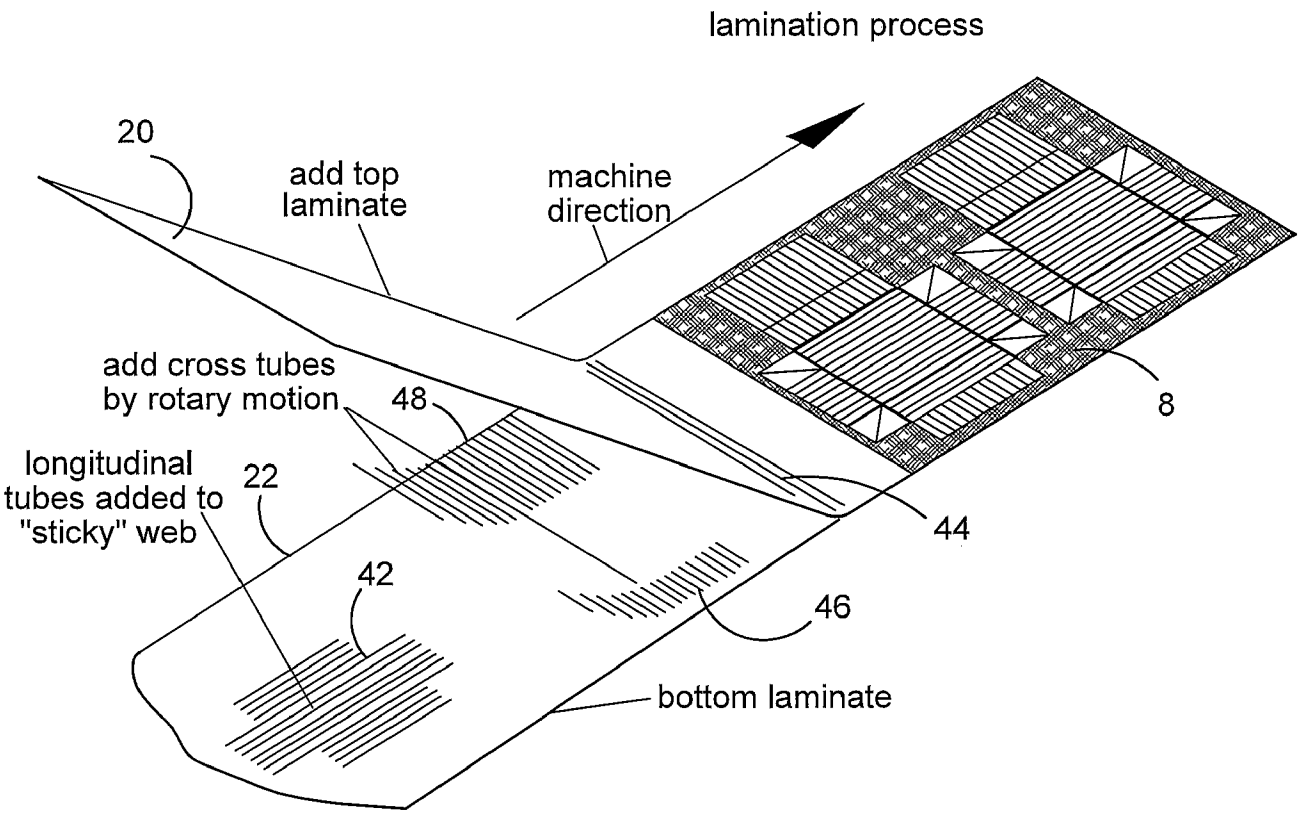
FIG. 11 shows diagrammatically the opening half of the production sequence for making a carton as shown in FIGS. 8-10.

Referring to FIG. 11, an upper supply roll (not shown) feeds a 1550 mm wide ribbon of transparent polythene as a top ply 20 toward a bottom ply 22 from a like roll (not shown). Coating rolls (not shown) apply adhesive to the meeting faces of the plies. While the adhesive is tacky a magazine releases a cruciform group of thin walled plastic tubes 42.

As the group progresses toward the confluence 44 of the plies two further magazines deposit two groups of tubes 46, 48 using rotary motion alongside the sides of the group 42 with the tube axes at 90° to the direction of feed.

Group 46 is intended to form extra wall 32. Group 48 is longer in length because it is intended to form the floor overlay 38 and extra wall 36. The lamination of the plies now occurs. The stippled area indicates the excess film surrounding the flat blank. Successive blanks are separated by break 8. The plies 20, 22 are severed at the break and the rectangular portion 50 (FIG. 12) is removed from the laminator.

Figure 12:
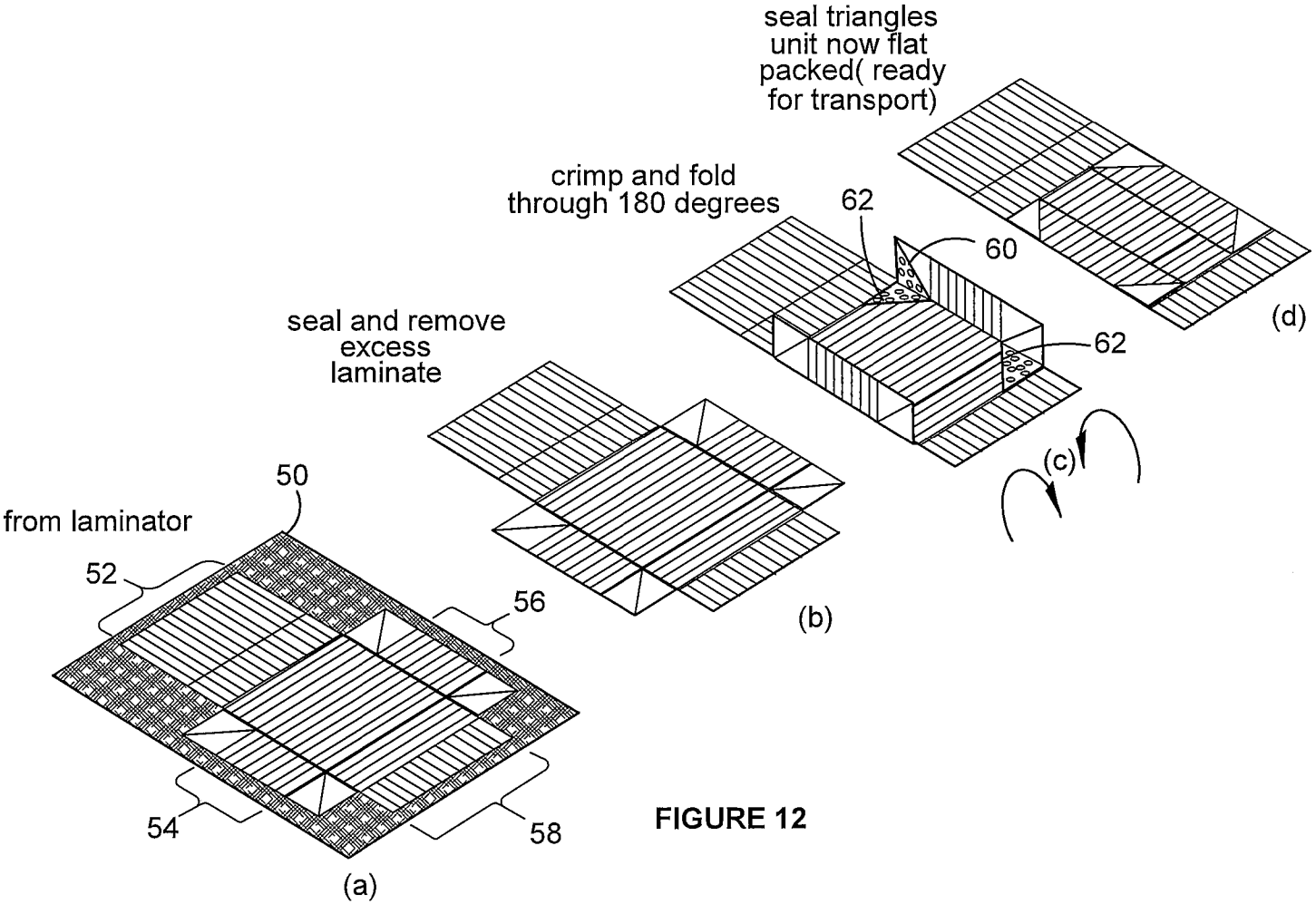
FIGS. 12*a-d* show diagrammatically the closing half of the production sequence of FIG. 11.

Referring now to FIG. 12, a sealing operation employs roller nips (not shown) to join the plies close to the ends of the tubes along lines 52, 54, 56 and 58. Cutters (not shown) incise the plies outside these lines leaving the cruciform blank with rectangular tubeless corner flaps 16 (see FIG. 12*b*). The blank in FIG. 12*b* is cold crimped and the end walls folded to stand upright as shown. The triangles marked 60 of ply coated with adhesive are adhered to sidewalls triangular portions 62 at all four corners. The sidewalls are folded flat to the assume the shape of the precursor shown in FIG. 12*d*.

We have found the advantages of the above embodiment to be:

1. Combines lightness and strength. A carton capable of holding 22 kg of meat weighs 400 g. The carton lid weighs about the same.
2. The carton and lid are water washable and reusable.

3. Combining the orientation of the tubes allows the carton and lid to withstand the pressure imposed by a conventional strapping machine.
4. The thermal insulation offered by the lidded carton is high and the contents remain cool long after the carton is removed from a cool store.
5. Plies can be printed before assembly into a carton blank which permits colour coding and all the print ability of cardboard.
6. Cartons can be selectively strengthened at suitable sites by simply increasing the wall thickness of the tubes composing the panels at the sites.
7. Cartons and lids can be assembled robotically from the precursors because they require no taping, stapling or application of adhesive to erect from the precursors and maintain their shape. Overlapping and tucking alone are required.

It is to be understood that the word "comprising" as used throughout the specification is to be interpreted in its inclusive form, ie. use of the word "comprising" does not exclude the addition of other elements.

It is to be understood that various modifications of and/or additions to the invention can be made without departing from the basic nature of the invention. These modifications and/or additions are therefore considered to fall within the scope of the invention.

The claims defining the invention are as follows:

1. A carton precursor for a liquid tight carton comprising:
a carton substrate ply having an obverse face and a reverse face and comprising multiple side-by-side thin-walled plastic tubes,
a top ply of liquid impervious film laminated to the obverse face, and
a bottom ply of liquid impervious film laminated to the reverse face,
whereby the carton substrate ply is between the top ply and the bottom ply,
and wherein the carton substrate ply has corner areas where the top and bottom plies are laminated together to form corner flaps,
the corner flap in each corner area defines a pair of triangles,
one of the triangles in each corner area is connected to an end wall of the carton precursor and the other triangle in each corner area is connected to a side wall of the carton precursor,
and in each corner area a side wall is joined to an end wall by the corner flap made into double thickness by a diagonal fold to impose an erectable shape on the carton precursor.

2. A carton precursor according to claim 1, wherein the carton substrate ply is substantially cruciform in plan and the film plies are rectangular in plan.

3. A carton precursor according to claim 1, wherein each end wall of the precursor has a depth double that of the side walls of the precursor whereby each end wall of the precursor is capable of being folded to form a carton end wall of double thickness.

4. A carton precursor according to claim 1, wherein the carton precursor has a floor, end walls and side walls, and the tubes in the floor, the end walls and the side walls of the carton precursor have central axes that all lie in a common direction.

5. A carton precursor according to claim 1, comprising a side wall extension connected to a side wall of the carton precursor, the side wall extension corresponding in shape to the side wall and being hinged to overlie the side wall in order to create a double thickness wall.

6. A carton precursor according to claim 5, wherein the tubes in the side wall extension have central axes that are transverse to central axes of the tubes in the side wall to which the side wall extension is connected.

7. A carton precursor according to claim 1, comprising a floor to which the side walls and the end walls are connected, a side wall extension connected to a side wall of the carton precursor, the side wall extension corresponding in shape to the side wall and being hinged to overlie the side wall in order to create a double thickness wall, and a floor overlay connected to the side wall extension, the floor overlay corresponding in shape to the floor to overlie the floor when the side wall extension overlies the side wall.

8. A carton precursor according to claim 7, wherein the tubes in the floor overlay have central axes that are transverse to central axes of the tubes in the floor.

9. A carton precursor according to claim 1, wherein the tubes are adhered to the plies.

10. A carton precursor according to claim 1, wherein the carton precursor has a floor, end walls and side walls and a hinge is formed between a side wall and the floor by the omission of at least one tube in the carton substrate ply along the axis of the hinge.

11. A carton precursor according to claim 1, wherein the top and bottom plies are sealed at the perimeter of the carton precursor thereby closing the ends of the tubes.

12. A carton precursor according to claim 1, wherein the carton precursor has a floor, end walls and side walls and a hinge is formed between an end wall and the floor by softening the tubes to allow bending the tubes transversely to axes of the tubes.

13. A carton precursor according to claim 1, wherein the carton is strengthened at suitable sites by including thicker walled tubes.

14. A carton precursor for a liquid tight carton comprising:
a carton substrate ply having an obverse face and a reverse face and comprising multiple side-by-side thin-walled plastic tubes, the carton substrate ply including a rectangular floor portion, a side wall portion at a first edge of the rectangular floor portion, and an end wall portion at a second edge of the rectangular floor portion, the second edge being adjacent the first edge,
a top ply of liquid impervious film laminated to the obverse face, and
a bottom ply of liquid impervious film laminated to the reverse face,
whereby the carton substrate ply is between the top ply and the bottom ply and the carton precursor includes an end wall and a side wall corresponding respectively to the end wall portion and the side wall portion of the carton substrate ply,
and wherein the carton substrate ply has a corner area between the side wall portion and the end wall portion where the top and bottom plies are laminated together to form a corner flap defining a pair of triangles connected respectively to the end wall and the side wall of the carton precursor,
and in each corner area a side wall is joined to an end wall by the corner flap made into double thickness by a diagonal fold to impose an erectable shape on the carton precursor.

15. A carton precursor according to claim 14, comprising a side wall extension connected to a side wall of the carton precursor, the side wall extension corresponding in shape to the side wall and being hinged to overlie the side wall in order to create a double thickness wall.

16. A carton precursor according to claim 15, wherein the tubes in the side wall extension have central axes that are transverse to central axes of the tubes in the side wall to which the side wall extension is connected.

17. A carton precursor according to claim 14, comprising a floor to which the side walls and the end walls are connected, a side wall extension connected to a side wall of the carton precursor, the side wall extension corresponding in shape to the side wall and being hinged to overlie the side wall in order to create a double thickness wall, and a floor overlay connected to the side wall extension, the floor overlay corresponding in shape to the floor to overlie the floor when the side wall extension overlies the side wall.

18. A carton precursor according to claim 17, wherein the tubes in the floor overlay have central axes that are transverse to central axes of the tubes in the floor.

19. A carton precursor according to claim 14, wherein the carton precursor has a floor, end walls and side walls and a hinge is formed between a side wall and the floor by the omission of at least one tube in the carton substrate ply along the axis of the hinge.

20. A carton precursor according to claim 14, wherein the carton is strengthened at suitable sites by including thicker walled tubes.

* * * * *